US006585667B1

(12) United States Patent
Müller

(10) Patent No.: US 6,585,667 B1
(45) Date of Patent: Jul. 1, 2003

(54) MASSAGING APPARATUS HAVING MASSAGING MEANS AND HANDLING MEANS

(75) Inventor: Ingo Müller, Klagenfurt (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/420,305

(22) Filed: Oct. 18, 1999

(30) Foreign Application Priority Data

Oct. 16, 1998 (EP) ..... 98890303

(51) Int. Cl.[7] ..... A61H 7/00
(52) U.S. Cl. ..... 601/6; 601/73; 601/74
(58) Field of Search ..... 601/6, 7, 9, 12, 601/70, 72, 73, 74, 80

(56) References Cited

U.S. PATENT DOCUMENTS 5,735,776 A * 4/1998 Swezey et al.
5,891,064 A * 4/1999 Van Herk et al. ..... 601/126
5,960,509 A * 10/1999 Wu ..... 15/244.2

FOREIGN PATENT DOCUMENTS

WO 98/02124 1/1998 ..... A61H/15/00

* cited by examiner

*Primary Examiner*—Danton D. DeMille
*Assistant Examiner*—Benjamin Koo
(74) *Attorney, Agent, or Firm*—Ernestine C. Bartlett

(57) ABSTRACT

A massaging apparatus (1) comprises a housing (5) having an upper wall (4) and side walls (5, 6, 7, 8) and a bottom wall (9), and massaging means (10) in the area of the bottom wall (9), which massaging means (10) are movable over a body area of a person, which massaging apparatus (1) comprises handling means (29) for holding and guiding the apparatus when the massaging means (10) are moved over a body area, which handling means comprise at least a part of the upper wall (4) of the housing (3) and, in addition, at least one strip-like handle member (30), such that a hand can be inserted at least partly between the handle member (30) and the upper wall (4) of the housing (3), the handle member (30) being preferably constructed so as to be elastic, soft, extensible in its longitudinal direction and continuously adjustable, and consists of a core (51) of a soft material and of a sleeve (52) of a material which is mild to the skin and which surrounds the core (51).

6 Claims, 2 Drawing Sheets

MASSAGING APPARATUS HAVING MASSAGING MEANS AND HANDLING MEANS

BACKGROUND OF THE INVENTION

The invention relates to a massaging apparatus for massaging body areas of a person, which apparatus comprises a housing having an upper wall and side walls and a bottom wall, and which comprises massaging means in the area of the bottom wall, which massaging means can be placed onto the skin of a body area during a massaging session and are preferably movable over a body area in a given operating direction, and which comprises handling means which are adapted to cooperate with a hand and by means of which the massaging apparatus and, as a consequence, the massaging means can be moved over a body area and which comprise at least a part of the upper wall of the housing and, in addition, at least one strip-like handle member which covers a part of the upper wall of the housing and which extends substantially transversely to the operating direction and which together with a part of the upper wall forms a passage into which a hand can be inserted at least partly, and which is constructed so as to be elastic and to be extensible in its longitudinal direction.

Such a massaging apparatus of the type defined in the opening paragraph is commercially available and is consequently known. Said known massaging apparatus comprises two handle members. Each of the two handle members is formed by a link band consisting of a plurality of articulated metal links. Such link bands are commonly known in particular in combination with watches. Owing to their metal structure such link bands are hard, which gives rise to problems when they form parts of handling means of a massaging apparatus because during use of a massaging apparatus comparatively large forces occur and, consequently, unpleasant pressure spots occur in the area of the back of the hand in the case of a longer time of use. Moreover, such link bands are comparatively unstable from a mechanical point of view, for which reason it is not surprising that the known massaging apparatus uses two such link bands. Furthermore, such link bands are comparatively expensive, which is unfavorable in view of a massaging apparatus which is as cheap as possible. In addition, cleaning such link bands is comparatively inconvenient.

SUMMARY OF THE INVENTION

It is an object of the invention to preclude the above-mentioned problems and to provide an improved massaging apparatus of the type defined in the opening paragraph, in which the afore-mentioned problems are solved by simple means. To achieve this object, according to the invention, a massaging apparatus of the type defined in the opening paragraph is characterized in that the handle member consists of a core of a soft material and of a sleeve of a material which is mild to the skin and which surrounds the core.

By taking the measures in accordance with the invention it is achieved in a simple manner and by simple and low-cost means that the massaging apparatus can be moved over a body area to be massaged by means of only one handle member and in a manner which is advantageous for a trouble-free massaging process. By taking the measures in accordance with the invention it is further achieved that an ergonomically very favorable construction for the handling means is obtained, which is advantageous for a particularly non-tiring use of the massaging apparatus. The non-tiring use of the massaging apparatus is enhanced by the soft material of the handle member. Such a soft handle member further has the advantage that a comfortable cooperation with the back of a hand is guaranteed and that even in the case of longer use no pressure spots occur at the back of the hand.

In a massaging apparatus in accordance with the invention the core of the handle member can, for example, consists of rubber. However, it has proved to be very advantageous if the core consists of a permanently elastic cellular material. In this respect, it has further proved to be advantageous if such core of a permanently elastic cellular material is surrounded with a sleeve of an elastic textile material. Practical tests have revealed that a cellular material which is commercially available as "neoprene" is advantageous as cellular material and a textile material which is commercially available as "lycra" is advantageous as textile material. Both materials are readily washable.

In a massaging apparatus in accordance with the invention it has proved to be particularly advantageous if the handle member is connected to a mounting element in the area of each of its end portions, which mounting element is detachably connected to the housing and then has a shape adapted to the housing shape in such a manner that the housing exterior does not exhibit any undesirable irregularities, which also might give rise to injuries. As a result of the provision of two mounting elements the handle member can simply be removed form the massaging apparatus in accordance with the invention, for example for cleaning purposes, after which the handle member may be cleaned, for example in a washing machine.

The afore-mentioned as well as further aspects of the invention will be apparent from the embodiment described hereinafter by way of example and will be elucidated with reference to this example.

BRIEF DESCRIPTION OF THE DRAWINGS

The invention will now be described in more detail with reference to the drawings, which show an embodiment given by way of example, to which the invention is not limited.

DESCRIPTION OF THE PREFERRED EMBODIMENTS

Figure 1:
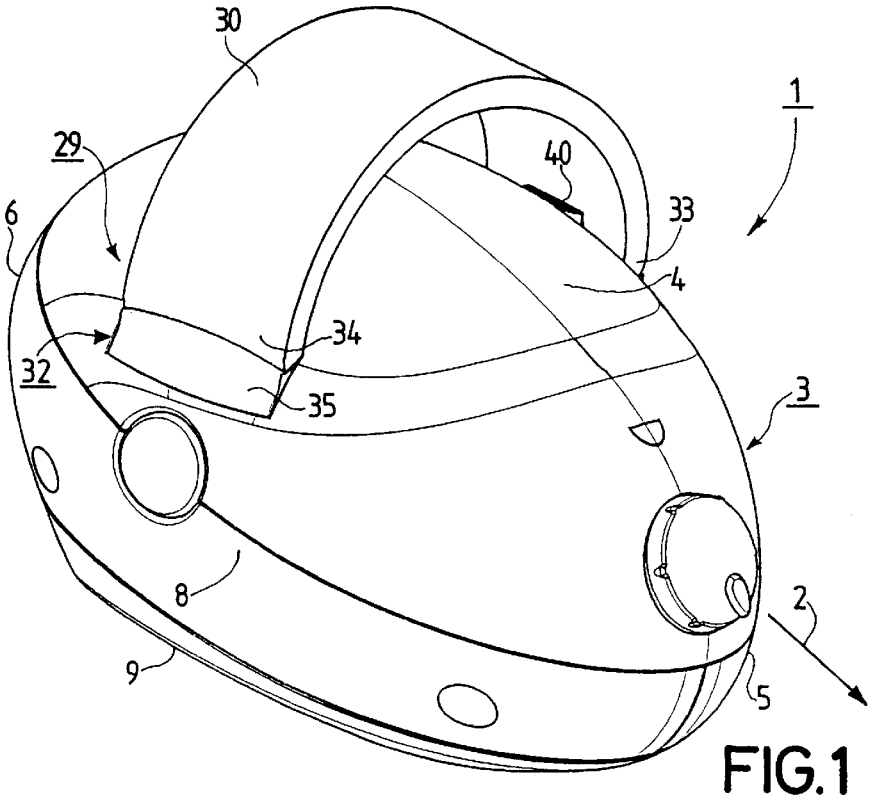
FIG. 1 is an oblique top view showing a massaging apparatus in accordance with an embodiment of the invention.
Figure 2:
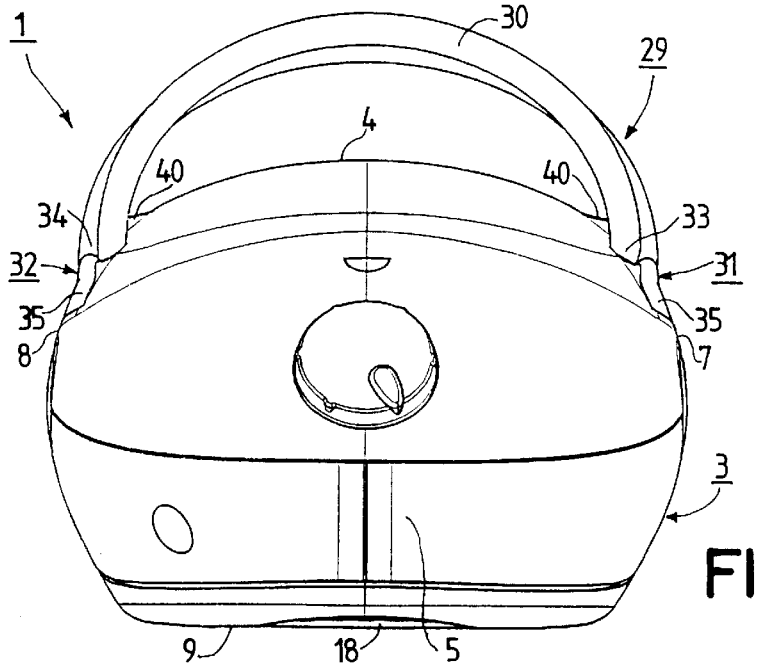
FIG. 2 shows the massaging apparatus of FIG. 1 in an underneath view.
Figure 3:
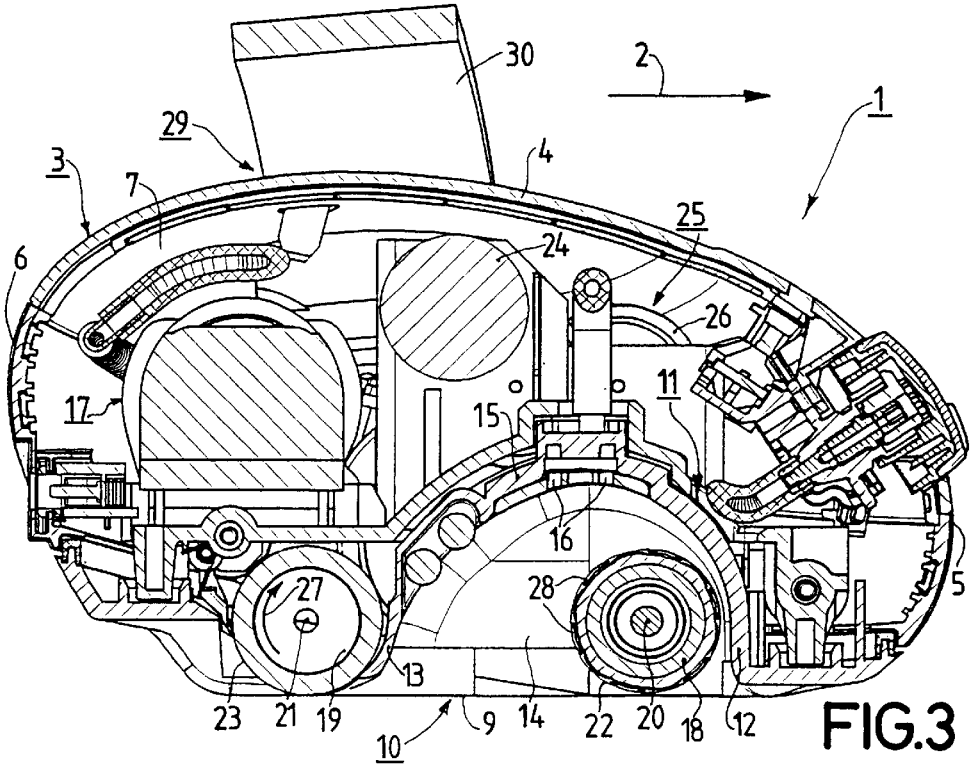
FIG. 3 shows the massaging apparatus of FIGS. 1 and 2 in a sectional view and also shows diagrammatically a skin fold formed during a massaging session.

FIGS. 1 to 3 show a massaging apparatus 1 intended for massaging body areas of a person. During a massaging session the massaging apparatus 1 can be placed onto a body area and is preferably movable over the skin in a given operating direction, which operating direction is indicated by an arrow 2 in FIGS. 1 and 3. As regards the design and construction of the massaging apparatus 1 reference can be made to the patent document WO 98/02124 A1, which is herewith incorporated by reference. In view of the detailed description of the known massaging apparatus disclosed in the patent document WO 98/02124 A1 the present Application only gives a detailed description of those design and construction features which differ from the known massaging apparatuses and which are relevant in the present context.

The massaging apparatus 1 comprises a housing 3 having an upper wall 4 and four side walls, namely a front side wall 5, a rear side wall 6, a left-hand side wall 7 and a right-hand side wall 8. The housing 3 has a bottom wall 9 at its side opposite to the upper wall 4.

The massaging apparatus 1 has massaging means 10 in the area of the bottom wall 9. The massaging means 10 include a suction chamber 11 which encloses a suction space and which comprises chamber walls 12 and 13,which extend substantially transversely to the operating direction 2 and which further comprises two chamber walls 14 which extend substantially parallel to the operating direction 2 and are connected to the two chamber walls 12 and 13 which extend transversely to the operating direction 2, only one of said chamber walls 14 being visible in FIG. 3. The suction chamber 11 is open at the location which faces the skin of a body area when the massaging apparatus 1 is placed on the skin with the bottom wall 9 of the housing 3, i.e. at the location of the bottom wall 9 of the housing 3. At the side opposite the open side the suction chamber 11 is closed by an upper chamber wall 15. The upper chamber wall 15 has passages 16 which are communicate with a pump 17 via an air-transfer duct, which for reasons of simplicity is not shown in FIG. 3, so as to allow the passage of air.

When the massaging apparatus 1 has been placed with its bottom wall 9 onto the skin of a body area the pump 17 can generate a partial vacuum inside the suction chamber 11 in order to form a skin fold 20 which is drawn into the suction chamber. Once such a skin fold has been drawn into the suction space of the suction chamber 11 and at the same time the massaging apparatus 1 is moved over the skin of a body area in the operating direction 2, the skin fold thus formed moves further in the operating direction 2, which produces a massaging effect.

In the area of the bottom wall 9 the massaging apparatus 1 further comprises two rollers 18 and 19, which are each rotatable about a respective roller axis 20 or 21 which extends transversely to the operating direction 2 and which can be placed onto the skin of a body area with their respective circumferential surfaces 22 and 23. Of the two rollers 18 and 19 the forward roller 18, as viewed in the operating direction 2, is disposed inside the suction chamber 11 and the rearward roller 19, as viewed in the operating direction 2, is disposed outside the suction chamber 11, as is apparent in from FIG. 3. The two rollers 18 and 19 can be driven rotationally by a motor 24 via a drive transmission 25, of which only an intermediate gear wheel 26 is visible in FIG. 3, namely in the same direction of rotation as indicated for the roller 19 by means of an arrow 27 in FIG. 3. Owing to this direction of rotation of the two rollers 18 and 19 the massaging apparatus 1 is driven in the operating direction 2 with the aid of the two rollers 18 and 19 by cooperation with the skin of a body area.

In the massaging apparatus 1 the circumferential surface 22 of the forward roller 18, as viewed in the operating direction 2, consists of a comparatively soft material and the circumferential surface 23 of the rearward roller 19, as viewed in the operating direction 2, consists of a comparatively hard material. Moreover, the circumferential surface 22 of the forward roller 18 is given a slightly concave shape and is provided with a multitude of studs 28, in order to promote the frictional effect of the roller 18 on the skin of a body area. The implementation of the circumferential surfaces 22 and 23 of the two rollers 18 and 19 as described in the foregoing, not only results in the massaging apparatus 1 being driven satisfactorily in order to move it over the skin of a body area but, in addition, it also enhances the formation of a skin fold in an advantageous manner, while in addition the two rollers 18 and 19 also produce a massaging effect. This means, in other words, that the two rollers 18 and 19 should also be regarded as parts of the massaging means 10 which can be placed onto the skin of a body area and which are preferably movable over a body area in the given operating direction.

The massaging apparatus 1 has handling means 29 for holding and guiding the massaging apparatus 1 over a body area, which means are adapted to cooperate with a hand and by means of which the massaging apparatus 1 and, as a consequence, the massaging means 10 can be moved over a body area.

In the massaging apparatus 1 the handling means 29 comprise a large part of the upper wall 4 of the housing 3 and, in addition, a strip-like handle member 30 as well as two mounting elements connected to the handle member 30.

The strip-like handle member 30 covers a part of the upper wall 4 of the housing 3 and extends substantially transversely to the operating direction 2, namely as an arc whose distance from the upper wall 4 of the housing 3 increases towards its central area, as a result of which the handle member 30 together with a part of the upper wall 4 of the housing 3 bounds a passage in which a hand can be inserted at least partly. This at least partial insertion is because the four fingers of a hand and the back of the hand including the hand palm can be inserted into said passage while the thumb can usually not be inserted. The insertion of a hand into the passage, i.e. the insertion of a hand between the handle member 30 and the large part of the upper wall 4 of the housing 3, should be performed in a direction opposite to the operating direction 2 for the recommended method of use of the massaging apparatus 1.

In the massaging apparatus 1 the handle member 30 is connected to the housing 3 in the area of its end portions 33 and 34 at the location of a respective side wall 7 or 8 of the housing 3. To connect the handle member 30 to the housing 3 the handle member 30 is connected to the two mounting elements 31 and 32 in the area of each of its end portions 33 and 34, respectively. Each of the mounting elements 31 and 32 is detachably connected to the housing 3, which is briefly described in more detail for the mounting element 32 with reference to FIG. 4.

Figure 4:
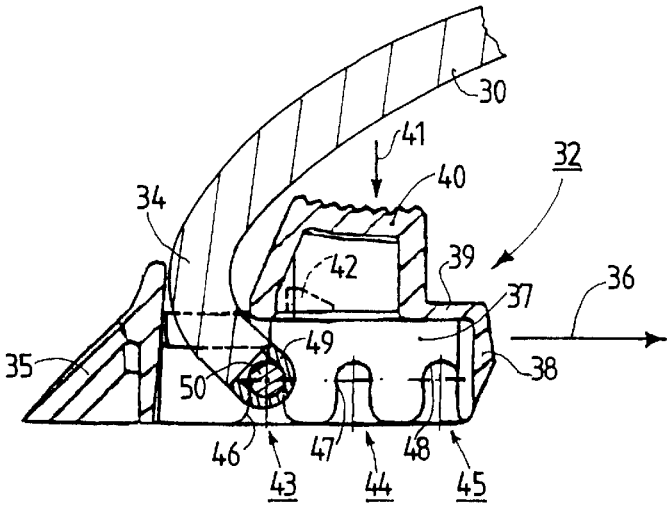
FIG. 4 is a sectional view showing a detail of the massaging apparatus of FIGS. 1 to 3, which detail concerns an end portion of a strip-like elastic and soft handle member which forms part of handling means of the massaging apparatus, which end portion is connected to a mounting element.

As is apparent from FIG. 4, the mounting element 32 consists of one piece and the mounting element 32 has an end portion 35 of a shape adapted to the exterior of the massaging apparatus 1, as can be seen in FIG. 1, to which end portions two limbs 37 are connected, which limbs project from the end portion 35 in the direction indicated by an arrow 36 and of which limbs only one limb 37 is visible in FIG. 4. At their ends which are remote from the end portions 35 both limbs 37 are connected to one another by a cross-piece 38. A button 40 is connected to the cross-piece via a resilient connecting portion 39. The button 40 can be pressed down in a direction indicated by an arrow 41, pressing the button 40 causing the resilient connecting portion 39 to be bent. At opposite sides of the button 40 two locking noses 42 have been provided, of which only one locking nose 42 is shown in broken lines in FIG. 4.

To connect the mounting element 32 to the housing 3 the housing 3 has a recess for the mounting element 32, into which recess, which is not shown, the mounting element 32 can be inserted in the direction indicated by the arrow 36, the locking noses 42 locking the mounting element 32 after the mounting element 32 has fully engaged the associated recess in the housing 3. When the mounting element 32 engages the recess in the housing 3 the button 40 engages an opening provided for this purpose, so that the button 40 remains accessible with a finger.

In order to enable the mounting element 32 to be removed from the housing 3 the button 40 must be moved in the direction indicated by the arrow 41, the locking noses 42 situated adjacent the button 40 then also being moved in the direction indicated by the arrow 41, after which the mounting element 32 can be moved out of the housing 3 in a direction opposite to that indicated by the arrow 36 with the aid of the button 40.

The mounting element 32 has three mounting positions 43, 44 and 45, which are each defined by two slots 46, 47 or 48. Of the two slots 46 one slot is formed in one limb 37 and the other slot in the other limb 37. The same applies to the two slots 47 and to the two slots 48. In the area of each of its two end portions 33 and 34 the handle member 30 can be connected detachably to the respective mounting elements 31 and 32 in any one of the mounting positions 43, 44 and 45. For detachably connecting an end portion 33 or 34 to the respective mounting element 31 or 32 the handle member 30 has an opening 49 through which a pin 50 is passed, both ends of the pin 50 projecting from the handle member 30. In this way each of the two ends of the pin 50 is engageable in a respective slot 46, 47 or 48 of a respective mounting position 43, 44 or 45, as is shown for the mounting position 43 in FIG. 4.

When each of the two pins 50 has engaged the mounting position 30 of the two mounting elements 31 and 32 the passage between the handle member 30 and the upper wall 4 of the housing 3 has its maximum clearance and is suitable to receive a comparatively big hand. In order to reduce this clearance each of the two mounting element 31 and 32 can be detached from the housing 3 after actuation of the buttons 40, upon which each of the two pins 50 is engageable in another mounting position 44 or 45, after which the two mounting elements 31 and 32 can again be locked to the housing 3. Thus, in the massaging apparatus 1 it is achieved in a particularly simple manner that the handling means can be adapted readily and without any special effort to hands of different sizes.

Figure 5:
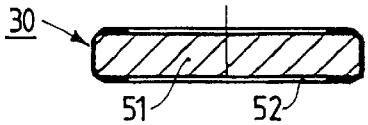
FIG. 5 is a sectional view showing the strip-like elastic and soft handle member of the massaging apparatus of FIGS. 1 to 3.

In a particularly advantageous manner the handle member 30 in the massaging apparatus 1 is constructed so as to be elastic, extensible in its longitudinal direction and continuously adjustable. This is achieved in that the handle member 30—as is illustrated in FIG. 5—consists of a core 51 of a soft material and a sleeve 52 surrounding the skin, which sleeve is made of a material which is mild to the skin. In the present case, the core 51 is made of a permanently elastic high-grade cellular material and the sleeve 52 is made of an elastic textile material. The permanently elastic high-grade cellular material is a cellular material which is commercially available as "neoprene". The elastic textile material is a textile material which is commercially available as "lycra".

The afore-mentioned construction of the elastic and soft handle member 30 which is extensible in its longitudinal direction and which is continuously adjustable has proved to be particularly advantageous for a proper and convenient use of the massaging apparatus 1, while even in the case of longer use a comfortable cooperation with a hand is guaranteed and pressure spots or other discomforts are precluded and at the same time a reliable and stable use has been made possible.

What is claimed is:

1. A massaging apparatus (1) for massaging body areas (3) of a person, said apparatus comprising a housing (5) having an upper wall (4) and side walls (5, 6, 7, 8) and a bottom wall (9), said housing comprising massaging means (10) in the area of the bottom wall (9), which massaging means (10) is placed onto the skin (2) of a body area (3) during a massaging session and is movable over said body area in a given operating direction (2), and which comprises handling means (29) adapted to cooperate with a hand and by means of which the massaging means (10) is moved over said body area, said handling means comprising at least a part of the upper wall (4) of the housing (3) and at least one strip-like handle member (30) which covers a part of the upper wall (4) of the housing (3) and which extends substantially transversely to the operating direction (2) and which together with a part of the upper wall (4) forms a passage adapted for inserting a hand at least partly, and which is elastic and is extensible in its longitudinal direction, the handle member consists of a core (51) of a soft material and of a sleeve (52) of a material which is non-irritating to the skin of the hand and which surrounds the core (51).

2. A massaging apparatus (1) as claimed in claim 1, wherein the core (51) consists of a permanently elastic cellular material and the sleeve (52) consists of an elastic textile material.

3. A massaging apparatus (1) as claimed in claim 1, wherein the handle member (30) is connected to a mounting element (31, 32) in the area of each of its end portions (33, 34), which mounting element is detachably connected to the housing (3).

4. A massaging apparatus (1) as claimed in claim 3, wherein each mounting element (31, 32) has an end portion (35) of a shape adapted to the exterior shape of the massaging apparatus (1) in the area adjacent the mounting element (31, 32).

5. A massaging apparatus (1) as claimed in claim 3, wherein each mounting element (31, 32) has a plurality of mounting positions (43, 44, 45), and in the area of each of its two end portions (33, 34) the handle member (30) can be connected detachably to the mounting element (31, 32) at each mounting position (43, 44, 45).

6. A massaging apparatus (1) as claimed in claim 1, wherein in the area of each of its two end portions (33, 34) the handle member (30) is connected to the housing (3) in the area of a side wall (7, 8) of the housing (3).

* * * * *